US006718889B1

(12) United States Patent
Brazier et al.

(10) Patent No.: US 6,718,889 B1
(45) Date of Patent: Apr. 13, 2004

(54) DRAFT CONTROLLED BOILER FUEL NOZZLE

(75) Inventors: Dennis Brazier, Greenbush, MN (US); Mark Jeremy Reese, Greenbush, MN (US); Rodney Lyle Tolefson, Greenbush, MN (US)

(73) Assignee: Central Boiler, Inc., Greenbush, MN (US)

( * ) Notice: Subject to any disclaimer, the term of this patent is extended or adjusted under 35 U.S.C. 154(b) by 0 days.

(21) Appl. No.: 10/231,503

(22) Filed: Aug. 30, 2002

(51) Int. Cl.[7] ..... F23B 7/00

(52) U.S. Cl. ..... 110/234; 110/265; 122/136 R; 431/144

(58) Field of Search ..... 431/150, 153, 431/15, 23, 18, 144, 253; 122/15.1, 136 R, 15; 126/361.1; 237/56; 110/187, 234, 262, 265

(56) References Cited

U.S. PATENT DOCUMENTS 2,758,637 A * 8/1956 Bergholdt et al. ..... 158/11
3,548,761 A * 12/1970 Zalman ..... 110/8
3,702,594 A * 11/1972 Howes ..... 110/8 R
4,140,067 A * 2/1979 Jensen ..... 110/262
4,309,965 A * 1/1982 Hill ..... 122/15
4,343,247 A * 8/1982 Chronowski ..... 110/245
4,362,269 A * 12/1982 Rastogi et al. ..... 236/14
4,389,980 A * 6/1983 Marcotte et al. ..... 122/114
4,451,226 A * 5/1984 Landis et al. ..... 431/15
4,517,906 A * 5/1985 Lewis et al. ..... 110/346
5,040,470 A * 8/1991 Lofton et al. ..... 110/234
5,259,342 A * 11/1993 Brady et al. ..... 122/367.1
5,329,920 A * 7/1994 Brazier ..... 126/344
5,730,069 A * 3/1998 Coolidge et al. ..... 110/187

* cited by examiner

*Primary Examiner*—Kenneth B. Rinehart
(74) *Attorney, Agent, or Firm*—DL Tschida

(57) ABSTRACT

A multi-fuel boiler having multiple, independent draft or combustion air sources and controls. A conventional oil/gas burner and nozzle assembly is fitted to an injector tube and isolated from a thermal transfer medium. A butterfly valve is supported in the injector tube and a motorized linkage directs valve operation. When the burner is non-operational, the valve prevents secondary combustion air from passing through the oil/gas burner to effect combustion in the firebox.

14 Claims, 5 Drawing Sheets

| Switch Position | Function |
|---|---|
| A | Wood Only |
| B | Clean Start |
| C | Backup |
| D | Power Burner Only |

DRAFT CONTROLLED BOILER FUEL NOZZLE

BACKGROUND OF THE INVENTION

The present invention relates to wood-fueled boilers that are capable of using multiple fuels (e.g. wood, fuel oil and/or natural or propane gas) and, in particular, to a boiler outfitted with a gas/oil burner assembly having an independently controlled, air control valve mounted between the firebox and burner nozzle.

Wood and biomass fueled boilers necessarily include air controls to vary the draft or amount of combustion air admitted to the firebox. Uncontrolled drafts are to be avoided, if optimized control is to be obtained over combustion.

Where the boiler is operable with multiple fuel sources, separate nozzle and burner assemblies are typically coupled to the firebox to admit heated combustion gases. The burner is typically controlled independently to assure continuing boiler operation, even if the wood fire is allowed to burnout. Operational problems can arise, however, from extraneous and uncontrolled airflow through the burner assembly that is not coordinated with the draft control to the wood fire.

The present improved boiler was developed to accommodate the foregoing need and appropriately control and/or isolate airflow through an oil/gas burner assembly relative to the firebox. An injector tube that contains an oil/gas nozzle and through which combustion gasses flow includes a butterfly valve to control airflow through the tube. The valve is normally closed, unless the burner is operational, to isolate the firebox from the ambient environment and unregulated air.

SUMMARY OF THE INVENTION

It is a primary object of the invention to provide a multi-fuel boiler with a combustion air-controlled oil/gas burner assembly.

It is further object of the invention to provide a boiler, primarily fueled by wood or other solid fuels, with a secondary burner assembly fueled by oil, gas and other non-solid fuels and having a separately controlled, independent source of combustion air that can be isolated from the firebox.

It is a further object of the invention to provide an injector tube that contains a fuel nozzle and a butterfly valve and which valve operates to isolate combustion air at the secondary burner assembly from the firebox when the burner isn't operating (i.e. wood fire only) to control extraneous airflow to the firebox.

It is further object of the invention to provide multiple modes of secondary burner operation to backup, supplement or replace wood combustion and during which the valve is open, for example, a) automatic secondary fuel backup, b) timed "startup"—secondary fuel burner fired for timed period at startup of wood fire, and c) oil/gas only. In the latter mode, the wood fire damper is closed.

The foregoing objects, advantages and distinctions of the invention are obtained in a presently preferred, butterfly controlled burner assembly. The assembly provides a conventional oil/gas burner and nozzle assembly that is fitted to an injector tube. A butterfly valve is supported in the injector tube, forward of the nozzle, and a motorized linkage directs valve operation. When the burner is non-operational, the valve isolates the oil/gas burner from the boiler to prevent drafts that can interfere with the regulation of the primary combustion air to the firebox.

Still other objects, advantages, distinctions and constructions of the invention will become more apparent from the following description with respect to the appended drawings. Similar components and assemblies are referred to in the various drawings with similar alphanumeric reference characters. The description should not be literally construed in limitation of the invention. Rather, the invention should be interpreted within the broad scope of the further appended claims.

Figure 1:
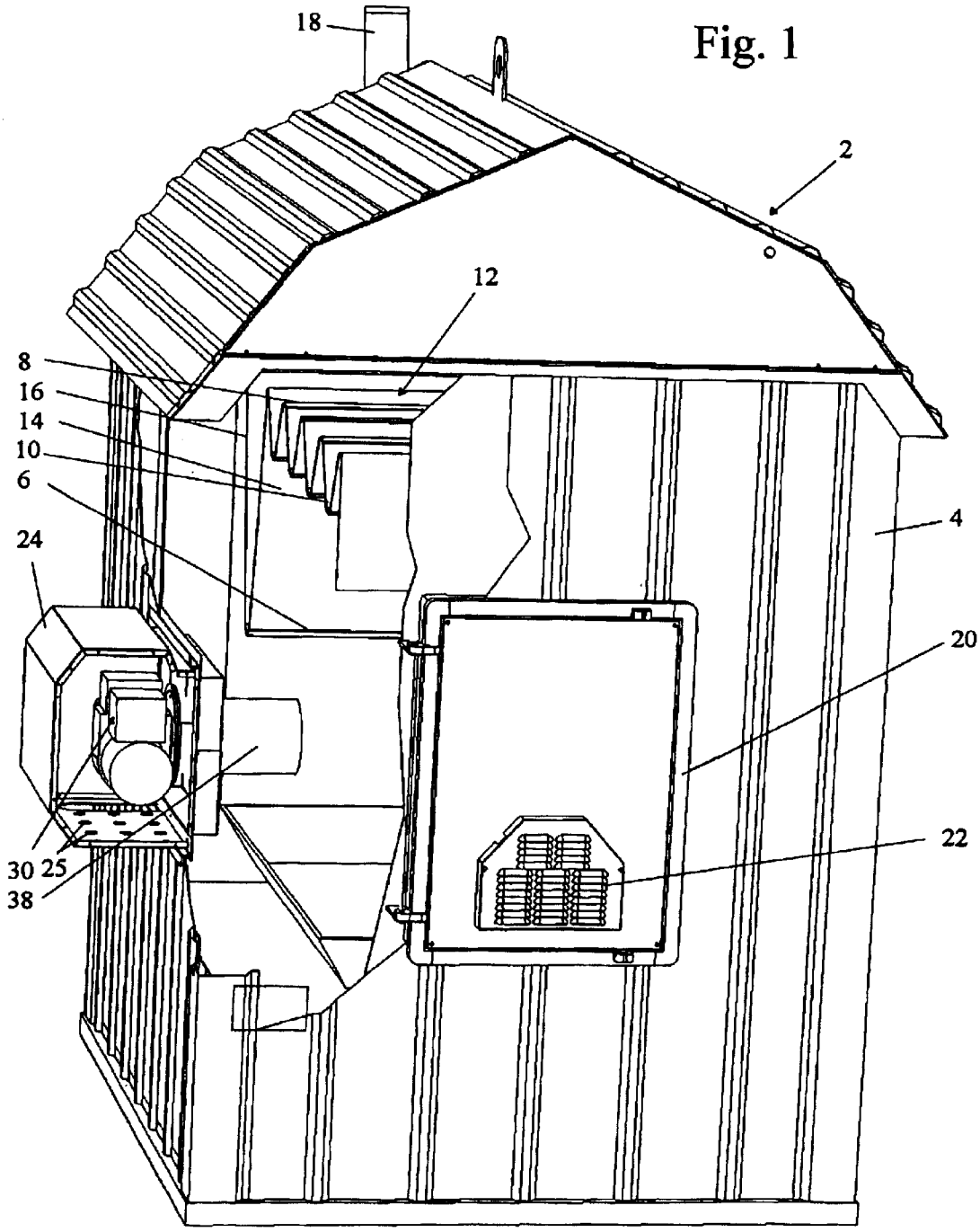
FIG. 1 is a perspective drawing shown in partial cutaway to a dual fuel fired boiler of the invention.

Similar structure throughout the drawings is referred to with the same alphanumeric reference numerals and/or characters.

DESCRIPTION OF THE PREFERRED EMBODIMENT

Referring to FIG. 1, a view is shown in partial section to a wood-fueled boiler 2. The boiler 2 includes an aesthetically pleasing external enclosure 4 that surrounds an internal firebox 6 and adjoining liquid heat exchange chamber 8. Convoluted channels 10 are formed in the top wall 12 of the firebox 6 to increase the thermal transfer surface area. A channel 14, immediately adjacent an exhaust space 16 and that opens to the chimney 18, depends substantially beneath the other channels 10 to screen the exhaust space and promote secondary combustion before the combustion gases are exhausted.

A hinged door 20 provides access to the firebox 6. A draft control 22, which is coupled to an aqua stat or other temperature sensitive controller, reference FIG. 5, regulates the draft and flow of combustion air to the firebox 6 to optimize combustion relative to the temperature of the thermal transfer media. A water/glycol mixture is typically used as the thermal transfer media and piped underground to the heated structure.

The principal fuel of the boiler 2 is wood, coal or other solid biomass material. The boiler 2, however, is adapted to permit any variety of alternative fuels that may be available in different regions. This also allows the user to reduce operating costs and provides user convenience, such as during burn down or startup periods.

An oil/gas burner assembly 24 is separately mounted to the enclosure 4 to accommodate such fuels. The assembly 24 extends through the heat exchange chamber 8 and into the firebox 6. The assembly 24 can accommodate fuel oil, propane or natural gas. Combustion air to the assembly 24 is independently and separately drawn from the ambient environment surrounding the enclosure 4 via vents 25. The assembly 24 is also capable of being isolated from the ambient environment and segregated from effecting the draft control 22, when not in use.

The burner assembly 24 is operable in the several modes, which include a) wood only, b) automatic dual fuel backup, which depending upon the temperature of the firebox provides heat even if the user does not refuel the firebox 6, b) clean start or timed "startup" which causes the secondary fuel burner to be fired for a timed period at startup of a wood fire to immediately create secondary combustion, and c) oil/gas only. In any of the modes when the present burner assembly 24 is operational, the burner assembly 24 can provide up to 250,000 BTU's with propane/natural gas and up to 420,000 BTU's with oil. The particular burner rating for each boiler 2, however, depends upon the burner and fuel type.

Figure 2:
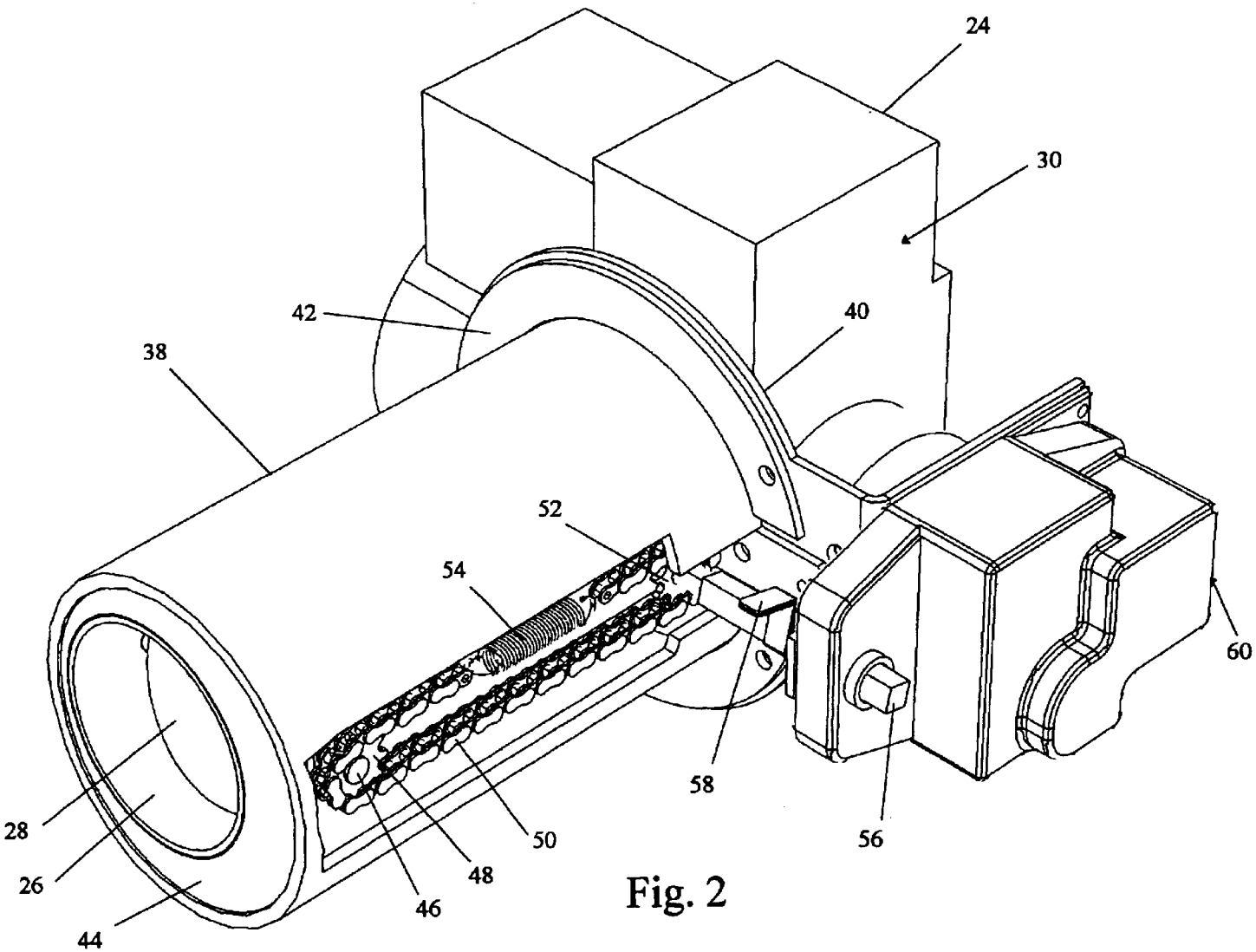
FIG. 2 is a perspective drawing of the water-cooled oil/gas injector assembly.

With additional attention to FIG. 2, the secondary fuel is appropriately admitted to the burner assembly 24 and the flame from combustion is directed through an injector tube 26, past a butterfly valve 28 and into the firebox 6. In each of the foregoing oil/gas modes, the valve 28 is held open to fully expose the bore of the injector tube 26 and the damper 22 is independently controlled to promote and/or maintain wood/solid fuel combustion. In a "wood only" mode, the valve 28 is closed and the damper 22 solely regulates the flow of combustion air to the firebox 6. Otherwise, leakage of air through the burner assembly 24 can interfere with and produce inefficiencies with the solid fuel combustion.

Figure 3:
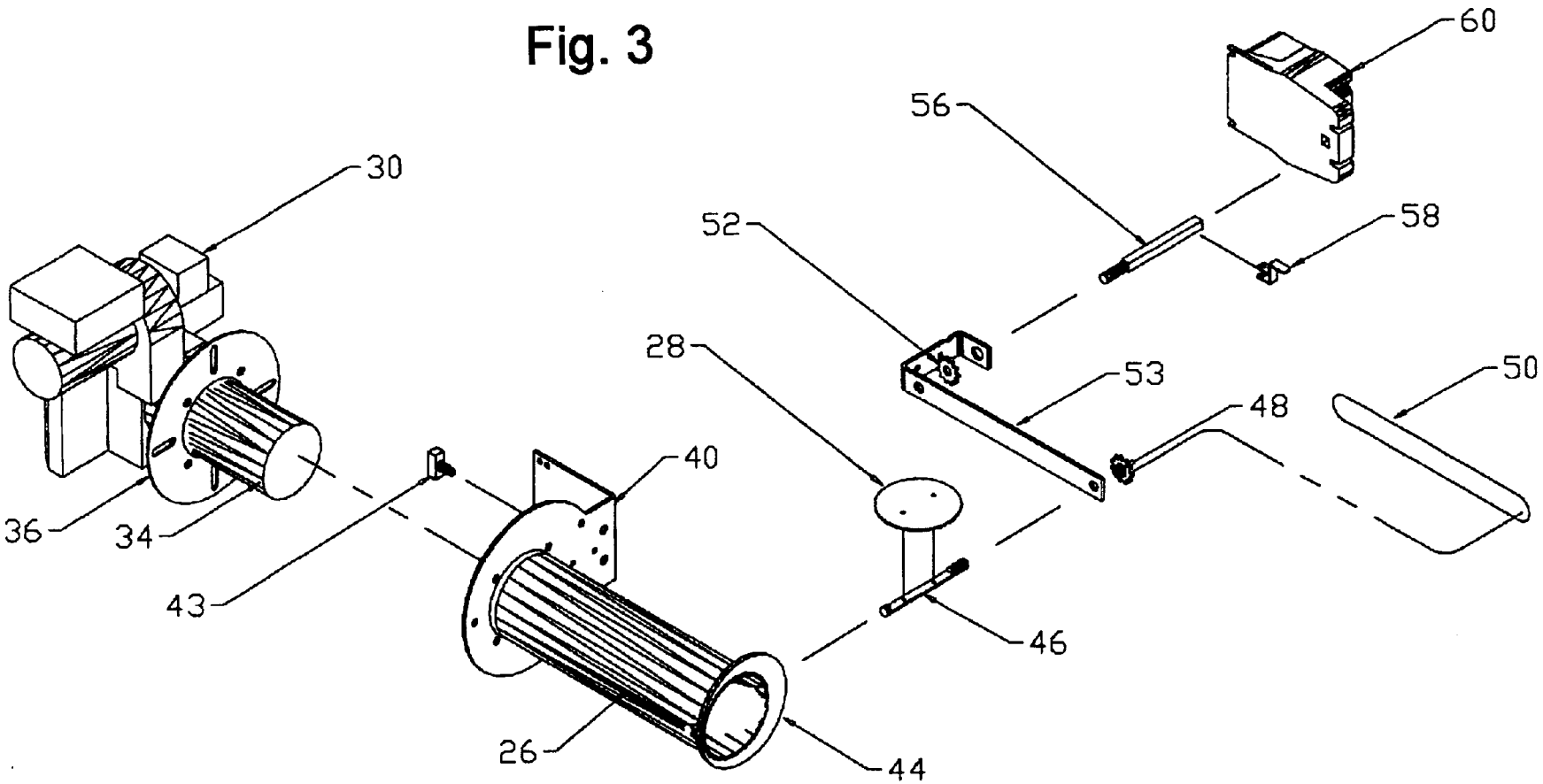
FIG. 3 is a perspective drawing shown in exploded assembly to the oil/gas injector assembly.
Figure 4:
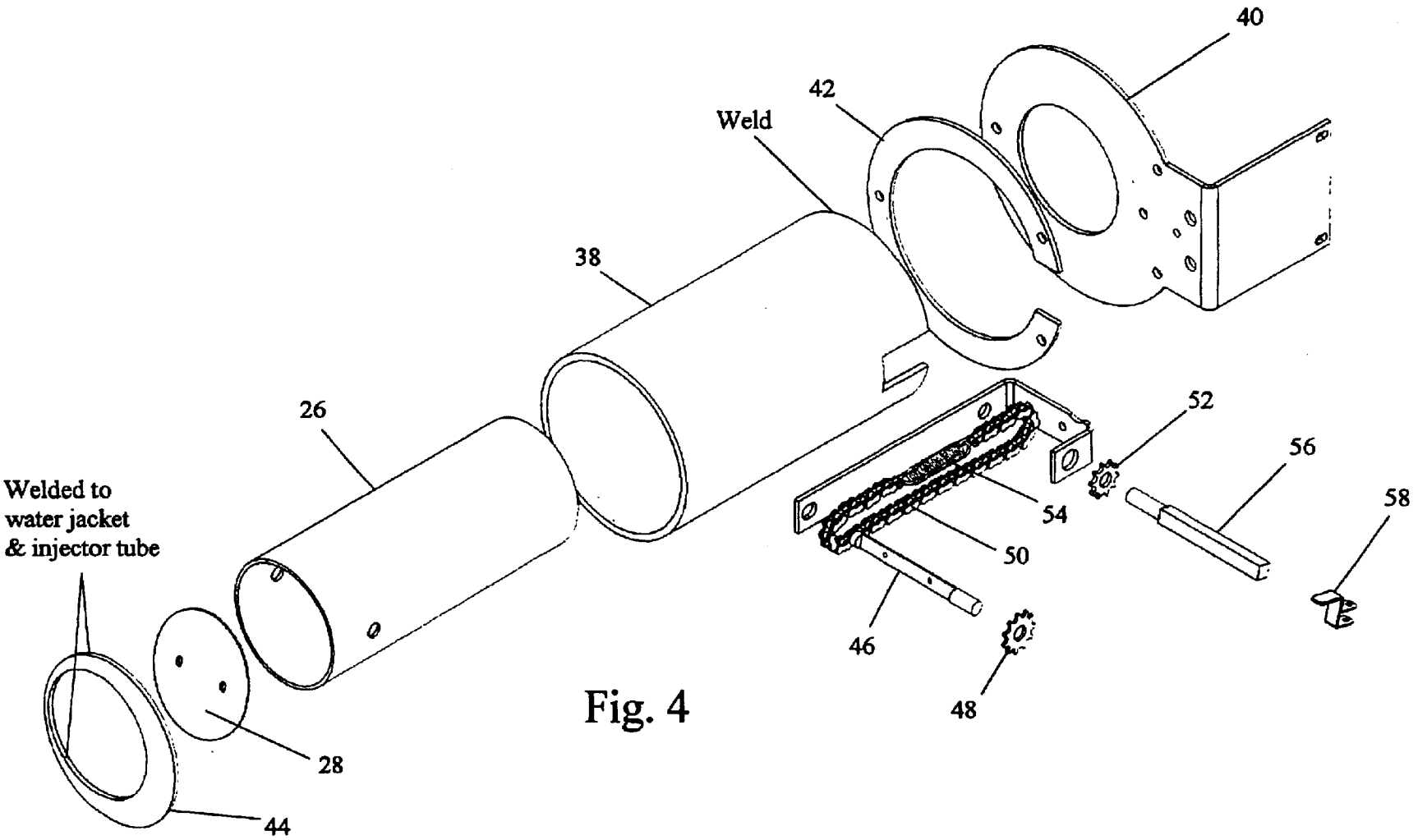
FIG. 4 is a perspective drawing shown in exploded assembly to the butterfly control linkage of the oil/gas injector assembly.
Figure 5:
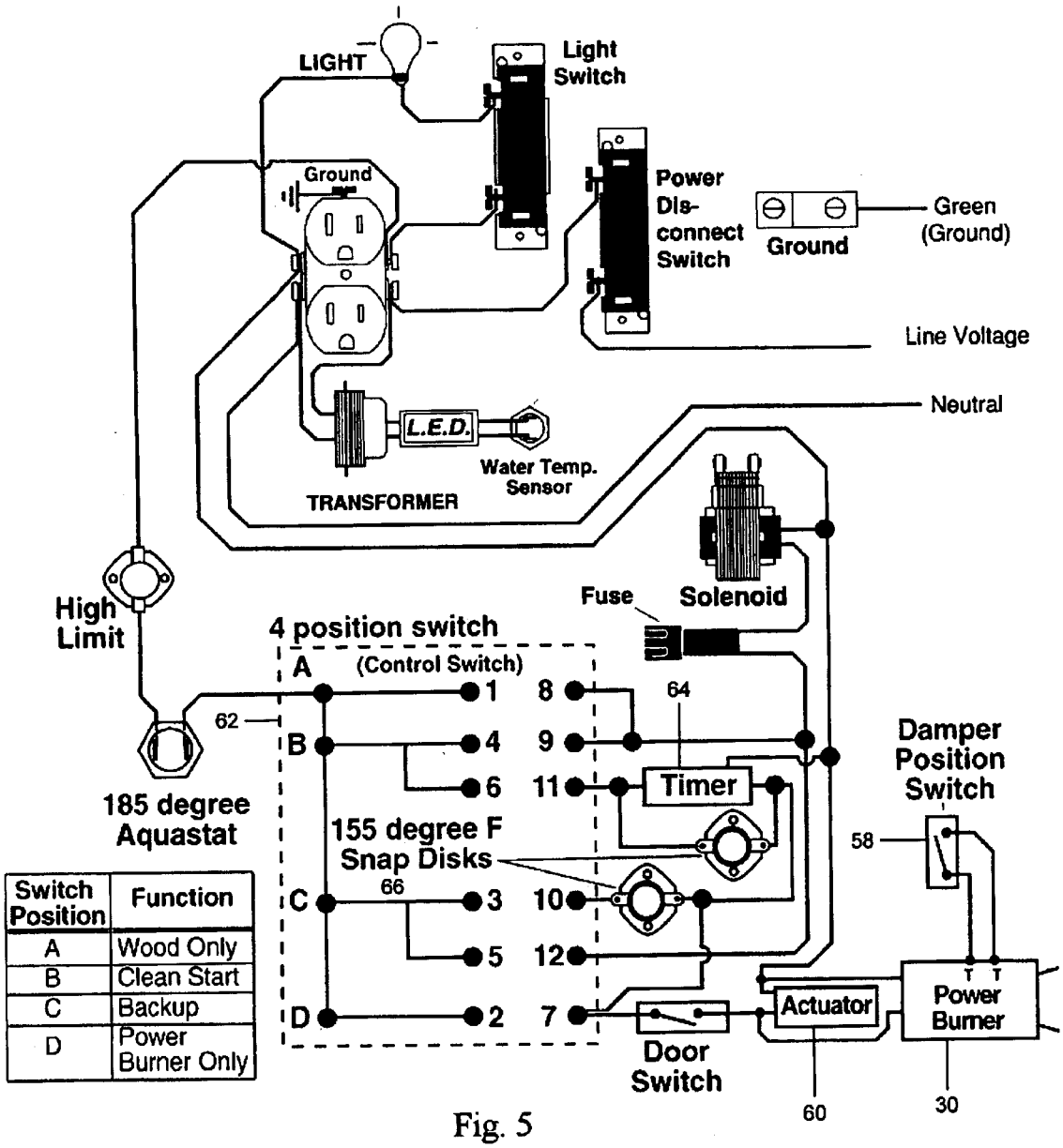
FIG. 5 is a schematic diagram of the electro-mechanical control for the boiler.

FIGS. 3 and 4 depict the detailed construction of the burner assembly 24 and the drive control to the valve 28. FIG. 5 depicts the electro-mechanical control schematic to the operation of the draft control 22 and burner assembly 24. The assembly 24 includes a conventional pressurized burner 30 that is compatible with a desired secondary fuel, such as fuel oil, propane gas or natural gas, waste oil, bio-diesel, vegetable oil to name a few of the many available non-solid fuels. A nozzle and orifice (not shown) is enclosed within a surrounding burner tube 34 along with an adjoining igniter (not shown) to control combustion with the benefit of air admitted from the vents 25.

A mounting plate 36 supports the burner 30 to a flange 40 attached to the injector tube 26. The plate 36 and flange 40, in turn, are secured to a flange 42 that is welded to the end of a waterjacket tube 38. The tube 38 projects through the heat exchange chamber 8 and into the firebox 6. The flange 42 is secured with fasteners 43 to the external walls of the boiler 2 and sealed to prevent leaking from the heat exchange chamber 8. A liquid thermal transfer medium surrounds the tube 38.

A forward, eccentric-shaped plate 44 is welded to the tubes 26 and 38 and generally supports the tubes 26 and 38 in concentric relation to each other. The butterfly valve 28 pivots in the tube 26 at an axle 46 that spans the bore of the tube 26 and extends at one side into the space between the tubes 26 and 38. A sprocket 48 mounts to the axle 46 and a chain linkage 50 extends to another sprocket 52 adjacent a bracket 53. A spring tensioner 54 is mounted along the length of the chain 50 to control chain tension and prevent chain breakage.

An axle 56 is secured to the sprocket 52 at the bracket 53. A damper position switch 58 sensitive to the rotation of said valve 28 is separately secured along the axle 56 and a motor 60 is coupled to the end of the axle 56. The motor 60 is separately attached to the flange 40.

A four-position switch 62 operates in concert with a timer 64 and temperature sensitive switches 66 (e.g. snap disks), shown at FIG. 5, and the switch 58 to control the operation of the motor 60 and rotation of the axle 56 and thereby the valve 28 during the foregoing modes. The valve 28, in turn, controls the flow of secondary combustion air to the firebox 6. The timer 64 operates during the "clean start" mode in concert with one of the switches 66 to provide a period of time during which the burner is operational to induce a draft in the firebox 6 or until the switch 66 opens. During the "backup" mode, the second switch 66 causes the burner 24 to operate at temperatures below the preset temperature of the switch (e.g. a nominal 155° F.).

A door switch is also provided at the door 20 to terminate or prevent operation of the burner assembly 24, if the door 20 is open.

While the invention has been described with respect to a number of preferred constructions and considered improvements or alternatives thereto, still other constructions may be suggested to those skilled in the art. It is also to be appreciated that selected ones of the foregoing features can be used singularly or can be arranged in different combinations to provide a variety of improved boiler assemblies. A variety of alternative air control valve structures, drive linkages and/or burner controls can be used in lieu of those described. The foregoing description should therefore be construed to include all those embodiments within the spirit and scope of the following claims.

What is claimed is:

1. A boiler assembly comprising:

a) a multi-walled firebox enclosing a space for burning combustible solid fuels and having a first source of combustion air coupled to said firebox;

b) a burner assembly mounted to direct flame into said firebox and coupled to a source of liquid or gaseous fuel and in communication with a second source of combustion air and including a conduit having a bore in communication with said second source of combustion air and mounted to direct flame into said firebox and wherein said conduit includes a plate mounted to pivot in said bore and coupled to a motorized drive linkage;

c) control means for controlling the combustion of said liquid and gaseous fuels at said burner assembly relative to the combustion of said solid fuels and for operating said plate to prevent the flow of combustion air from said second source into said firebox when said burner assembly is non-operational; and d) a liquid heat exchanger coupled to said firebox to extract heat from said firebox and heat a liquid medium.

2. A boiler assembly as set forth in claim 1 wherein said motorized drive linkage includes a chain and a resilient member for controlling the tension on said chain.

3. A boiler assembly as set forth in claim 1 wherein said motorized drive linkage includes an endless member and a resilient member coupled to said endless member for controlling the tension on said endless member.

4. A boiler assembly comprising:

a) a multi-walled firebox enclosing a space for burning combustible solid fuels and having a first source of combustion air coupled to said firebox;

b) a burner assembly mounted to direct flame into said firebox and coupled to a source of liquid or gaseous fuel and in communication with a second source of combustion air and including a conduit having a bore in communication with said second source of combustion air and mounted to direct flame into said firebox and wherein said conduit includes a plate mounted to pivot in said bore and coupled via a drive linkage, that includes an endless member and a resilient member coupled to said endless member for controlling the tension on said endless member, to a motor; and c) control means for controlling the combustion of said liquid and gaseous fuels at said burner assembly relative to the combustion of said solid fuels and for operating said plate to prevent the flow of combustion air from said second source into said firebox when said burner assembly is non-operational.

5. A boiler assembly as set forth in claim 4 wherein said control means operates in a plurality of modes to rotate said plate to admit combustion air from said second combustion air source to said burner assembly to support solid fuel combustion.

6. A boiler assembly as set forth in claim 4 including a backup mode that senses the temperature of the firebox and during which said plate is open and the burner is operational to provide heat until the solid fuel fire maintains the temperature in excess of a minimum temperature.

7. A boiler assembly comprising:

a) a multi-walled firebox enclosing a space for burning combustible solid fuels and having a first source of combustion air coupled to a said firebox;

b) a heat exchanger surrounding said firebox to extract heat from said firebox and transfer said heat to a liquid medium;

c) a burner assembly including a conduit having a bore mounted to direct flame into said firebox and coupled to a source of liquid or gaseous fuels and in communication with a second and independent source of combustion air; and d) control means for controlling the combustion of said liquid and gaseous fuels at said burner assembly relative to the combustion of said solid fuels and wherein said conduit has a bore and includes a plate mounted to pivot in said bore and coupled via a drive linkage, that includes an endless member and a resilient member coupled to said endless member for controlling the tension on said endless member, to a motor to prevent the flow of combustion air from said second source of combustion air into said firebox when said burner assembly is non-operational.

8. A boiler assembly as set forth in claim 7 wherein said valve comprises a plate mounted to pivot in said bore and coupled via a drive linkage, that includes an endless member and a resilient member coupled to said endless member for controlling the tension on said endless member, to a motor.

9. A boiler assembly as set forth in claim 7 wherein said control means operates in a plurality of modes to rotate said plate to admit combustion air from said second combustion air source to said burner assembly to support solid fuel combustion.

10. A boiler assembly as set forth in claim 9 including a backup mode that senses the temperature of the firebox and during which said plate is open and the burner is operational to provide heat until the solid fuel fire maintains the temperature in excess of a nominal temperature.

11. A boiler assembly as set forth in claim 9 including a timed startup mode and during which said plate is open and said burner assembly is operational for a predetermined time at the startup of a solid fuel fire.

12. A boiler assembly comprising:

a) a multi-walled firebox enclosing a space for burning combustible solid fuels and having a first source of combustion air coupled to a said firebox;

b) a burner assembly mounted to direct flame into said firebox and coupled to a source of liquid or gaseous fuel and in communication with a second source of combustion air and including a conduit having a bore and wherein said conduit includes a valve; and c) control means for controlling the combustion of said liquid and gaseous fuels at said burner assembly relative to the combustion of said solid fuels, wherein said valve is controlled to prevent the flow of combustion air from said second combustion air source into said firebox when said burner assembly is non-operational, and wherein said control means operates in a plurality of modes to direct said valve to admit combustion air from said second combustion air source to said burner assembly to support solid fuel combustion.

13. A boiler assembly comprising:

a) a multi-walled firebox enclosing a space for burning combustible solid fuels and having a first source of combustion air coupled to a said firebox;

b) a burner assembly mounted to direct flame into said firebox and coupled to a source of liquid or gaseous fuels and in communication with a second source of combustion air and including a conduit having a bore and wherein said conduit includes a valve; and c) control means for controlling the combustion of said liquid and gaseous fuels at said burner assembly relative to the combustion of said solid fuels, wherein said valve is controlled to prevent the flow of combustion air from said second combustion air source into said firebox when said burner assembly is non-operational, and wherein said control means operates in a backup mode that senses the temperature of the firebox and during which said valve is open and the burner is operational to provide heat until the solid fuel fire maintains the temperature in excess of a nominal temperature.

14. A boiler assembly comprising:

a) a multi-walled firebox enclosing a space for burning combustible solid fuels and having a first source of combustion air coupled to a said firebox;

b) a burner assembly coupled to a source of liquid or gaseous fuels and in communication with a second and independent source of combustion air and including a conduit having a bore mounted to direct flame into said firebox and wherein said conduit includes a value; and c) control means for controlling the combustion of said liquid and gaseous fuels at said burner assembly relative to the combustion of said solid fuels, wherein said valve is controlled to prevent the flow of combustion air from said second combustion air source into said firebox when said burner assembly is non-operational, and wherein said control means operates in a timed startup mode and during which said valve is open and said burner assembly is operational for a predetermined time at the startup of a solid fuel fire.

* * * * *